US005584274A

United States Patent [19]

Fukui et al.

[11] Patent Number: 5,584,274

[45] Date of Patent: Dec. 17, 1996

[54] APPARATUS FOR CONTROLLING OPERATION TIMING OF INTERNAL COMBUSTION ENGINE

[75] Inventors: Wataru Fukui; Yasukazu Koezuka, both of Tokyo, Japan

[73] Assignee: Mitsubishi Denki Kabushiki Kaisha, Tokyo, Japan

[21] Appl. No.: 598,015

[22] Filed: Feb. 7, 1996

[30] Foreign Application Priority Data

Apr. 6, 1995 [JP] Japan ..... 7-081355

[51] Int. Cl.[6] ..... F02P 5/00

[52] U.S. Cl. ..... 123/414; 123/417

[58] Field of Search ..... 123/414, 416, 123/417, 613, 612, 617, 643; 73/116

[56] References Cited

U.S. PATENT DOCUMENTS

| | | | |
|---|---|---|---|
| 5,325,710 | 7/1994 | Morikawa | 73/116 |
| 5,329,904 | 7/1994 | Kokubo et al. | 123/414 |
| 5,333,586 | 8/1994 | Fukui | 123/414 |
| 5,345,909 | 9/1994 | Fukui et al. | 123/414 |
| 5,429,093 | 7/1995 | Fukui et al. | 123/414 |
| 5,469,823 | 11/1995 | Ott et al. | 123/414 |
| 5,487,008 | 1/1996 | Ribbens et al. | 364/431.04 |
| 5,494,017 | 2/1996 | Miyata et al. | 123/414 |

FOREIGN PATENT DOCUMENTS 3168346 7/1991 Japan .

*Primary Examiner*—Raymond A. Nelli

*Attorney, Agent, or Firm*—Sughrue, Mion, Zinn, Macpeak & Seas

[57] ABSTRACT

An engine control apparatus for an internal combustion engine which is capable of performing engine cylinder identification economically, rapidly and easily with high accuracy, while capable of performing a backup control upon occurrence of abnormality. The control apparatus includes a first signal detector (81) provided in association with a crank shaft (11) for obtaining a first signal series, a second signal detector (82) provided in association with a cam shaft (1) for obtaining a second signal series (SGC) and a control means (100) for controlling parameter (P) involved in operation of the engine on the basis of each signal series. The first signal series includes an angular position signal and a reference position signal (θR) for a specific cylinder group, while the second signal series includes cylinder identifying signal pulses. The pulse identifying a given cylinder differs from those for the other cylinders. The control means (100) includes a means (101) for detecting the reference position signal on the basis of the first signal series, a means (101A) for detecting reference positions for the individual cylinders on the basis of the first signal series, a means (102) for identifying the cylinder group on the basis of the reference position signal, a means (103) for identifying the cylinders on the basis of the second signal series, a means (104) for arithmetically determining control timings for controlling the parameter on the basis of the results of the cylinder identification and the second signal series, and an abnormality decision means (105) for the signal series.

9 Claims, 6 Drawing Sheets

APPARATUS FOR CONTROLLING OPERATION TIMING OF INTERNAL COMBUSTION ENGINE

BACKGROUND OF THE INVENTION

1. Field of the Invention

The present invention generally relates to a control apparatus for controlling operation timing of an internal combustion engine by identifying reference positions of individual engine cylinders, respectively. More particularly, the present invention is concerned with a control apparatus for an internal combustion engine which can rapidly perform the cylinder identification to be reflected onto the timing control with a relative simplified structure while deriving a reference position signal relating to a crank shaft with high reliability to thereby ensure an enhanced accuracy for the timing control and which apparatus is capable of carrying out a backup control of the internal combustion engine even in the case where an angular position signal containing the reference position signal or the cylinder identifying signal can not be obtained.

2. Description of Related Art

In general, in a control system for an internal combustion engine (hereinafter also referred to simply as the engine), there are employed a reference position signal and a cylinder identifying signal generated in synchronism with rotation of the engine with a view to controlling the ignition timing, quantity of fuel to be injected into the engine and others. Usually, the signal generator for generating these signals is mounted on a cam shaft of the engine and structured such that one-to-one correspondence to the engine cylinders can be established for thereby detecting indirectly the rotational positions of a crank shaft.

For having better understanding of the present invention, technical background thereof will be descried in some detail. FIG. 8 is a perspective view showing a mechanical structures of a rotation signal generator employed in a hitherto known engine control system, and FIG. 9 is a circuit diagram showing an electric signal processing circuit provided in association with the structure shown in FIG. 8, both of which are disclosed in Japanese Unexamined Patent Application Publication No. 68252/1994 (JP-A-6-68252), wherein the internal combustion engine of concern is assumed to have six cylinders.

Referring to the figures, a cam shaft 1 is driven at a speed equal to a half of the rotation speed (rpm) of a crank shaft (not shown) so that the control timings for all the six cylinders can be covered by a single rotation of the cam shaft 1.

A rotating disk 2 secured integrally to the cam shaft 1 so as to corotate therewith is formed with a series of radial slits 3*a* in an outer peripheral portion of the rotating disk 2 with equal angular distance therebetween for generating an angular position signal POS composed of a series of pulses generated at every predetermined angle during rotation of the rotating disk 2 and a number of windows 3*b* for generating reference position signals REF in one-to-one correspondence to the engine cylinders, respectively.

Light emission diodes (LED) 4*a* and 4*b* are disposed fixedly at a position facing a circular array of the slits 3*a* and a position facing a circular array of the windows 3*b*, respectively. Further, photodiodes 5*a* and 5*b* are disposed in opposition to the light emission diodes 4*a* and 4*b*, respectively, with the rotating disk 2 being interposed therebetween, wherein the light emission diodes 4*a*, 4*b* and photodiodes 5*a*, 5*b* cooperate to constitute photocouplers, respectively.

Referring to FIG. 9, there are provided amplifier circuits 6*a* and 6*b* connected to output terminals of the photodiodes 5*a* and 5*b*, respectively, and output transistors 7*a* and 7*b* connected to the output terminals of the amplifier circuits 6*a* and 6*b*, respectively.

The rotating disk 2, the photocouplers (4*a*; 5*a*) and (4*b*; 5*b*), the amplifier circuits 6*a* and 6*b* and the output transistors 7*a* and 7*b* constitute a rotation signal generator 8 for generating the angular position signal POS and the reference position signal REF.

FIG. 10 is a block diagram showing an engine control system known heretofore. Referring to the figure, the angular position signal POS and the reference position signal REF outputted from the rotation signal generator 8 are supplied to a microcomputer 10 by way of an interface circuit 9 to be utilized for controlling the ignition timing, the fuel injection quantity and others.

FIG. 11 is a waveform diagram for illustrating the angular position signal POS and the reference position signal REF outputted from the rotation signal generator 8.

Referring to FIG. 11, the angular position signal POS is comprised of a series of pulses generated in correspondence to the slits 3*a*, respectively, formed in the rotating disk 2, wherein each of the pulses of the angular position signal POS is generated, for example, at every crank angle of 1°. Thus, the angular position signal POS can be used for measuring the angular position of the crank shaft. On the other hand, the reference position signal REF has a pulse sequence repeated upon every rotation of the crank shaft over a crank angle of 720°. More specifically, the pulse sequence of the reference position signal REF includes six pulses each rising up at a predetermined crank angle in correspondence to each of the engine cylinders, wherein the six pulses have respective pulse widths which differ from one to another engine cylinder so that they can be used as the cylinder identifying signals, respectively.

The conventional engine control apparatus described above by reference to FIGS. 8 to 10 can discriminatively identify the individual engine cylinders and the reference positions (crank angles) on the basis of the angular position signal POS and the reference position signal REF for effectuating optimal control of the ignition timing, the fuel injection quantity and others in dependence on the engine operation states.

However, because the cam shaft 1 is driven from the crank shaft by way of a transmission mechanism such as a transmission belt/pulley mechanism (not shown), there may arise a phase difference in rotation between the cam shaft and the crank shaft, depending on the engine operation states. As a result, the angular positions indicated by the angular position signal POS and the reference position signal REF generated by the rotation signal generator 8 may undesirably be deviated or offset from the actual crank angle. Accordingly, when the engine operation control is performed on the basis of the signals suffering the phase deviation, the control of the ignition timing and other will naturally be accompanied with corresponding deviation, whereby it may become impossible to obtain the engine operation performance as intended.

To cope with the problem mentioned above, there has already been proposed such an apparatus which is so implemented as to generate the angular position signal POS and the reference position signal REF with high accuracy in association with the crank shaft while generating only the cylinder identifying signals bearing one-to-one correspondence to the individual engine cylinders, respectively, in association with the cam shaft 1, as is disclosed, for example, in Japanese Unexamined Patent Application Publication No. 68252/1994 (JP-A-6-68252).

However, the engine control system disclosed in the above publication suffers shortcomings in that the sensor as well as peripheral devices thereof provided in association with the crank shaft for generating the angular position signal POS and the reference position signal REF is much complicated and expensive and that a great difficulty is encountered in realizing a backup control in the case where either one of the angular position signal POS or the reference position signal REF becomes unavailable due to occurrence of abnormality or fault in the sensors provided in association with the crank shaft or when the cylinder identifying signal can not be obtained due to occurrence of abnormality or defect in the sensor provided in association with the cam shaft 1, incurring possibly shutdown of the engine operation.

As is apparent from the foregoing, the engine control apparatus known heretofore suffers a problem that the detection accuracy of the angular position signal POS and the reference position signal REF is impaired when the rotation signal generator 8 is provided in association with the cam shaft 1 because of possibility of the phase difference in rotation between the rotation signal generator 8 and the crank shaft, as a result of which deviation or error is involved in the control of the ignition timing and other, presenting a great obstacle in realizing the performance as intended.

On the other hand, in the case of the engine control apparatus such as disclosed in Japanese Unexamined Patent Application Publication No. 68252/1994 (JP-A-6-68252) where the angular position signal POS and the reference position signal REF are generated by the sensor device provided in association with the crank shaft, while the cylinder identifying signal is generated by the means provided in association with the cam shaft, there arises problems that the sensor and peripheral devices provided in association with the crank shaft are much complicated and that the backup control can not be carried in the case where the angular position signal POS, the reference position signal REF or the cylinder identifying signal becomes unavailable.

SUMMARY OF THE INVENTION

In the light of the state of the art described above, it is an object of the present invention to provide an engine control apparatus which is capable of performing rapidly engine cylinder identification which is to be reflected to the timing control of the engine with a relatively simplified structure.

It is another object of the present invention to provide an engine control apparatus which can allow the reference position signal REF to be acquired with high reliability in association with the crank shaft to thereby enhance the accuracy of the timing control involved in the control of engine operation.

It is yet another object of the present invention to provide an engine control apparatus which is capable of performing a backup control even in the case where the angular position signal containing the reference position signal or the cylinder identifying signal is not available.

In view of the above and other objects which will become apparent as the description proceeds, there is provided according to a general aspect of the present invention an apparatus for controlling operation of an internal combustion engine, which apparatus includes a first signal detector for generating a first signal series relating to rotation of a crank shaft of the internal combustion engine, a second signal detector for generating a second signal series relating to rotation of a cam shaft driven with a speed reduction ratio of "½" relative to the crank shaft, and a control means for controlling parameter or parameters involved in operation of the internal combustion engine on the basis of at least one of the first and second signal series mentioned above. The first signal series includes an angular position signal generated at every first predetermined angular position in synchronism with the rotation of the crank shaft and a reference position signal generated at every second predetermined angular position corresponding to a reference position of a specific cylinder group of the engine. The second signal series is formed by pulses corresponding to the individual engine cylinders, respectively, and contains a cylinder identifying signal, wherein a pulse form of the cylinder identifying signal at least for a given one of the engine cylinders differs from those for the other engine cylinders. The control means which may be constituted by a microcomputer includes a reference position detecting means for detecting the reference positions of the individual cylinders on the basis of the angular position signal and the reference position signal, a cylinder group identifying means for identifying the cylinder group on the basis of the reference position signal, a cylinder identifying means for discriminatively identifying each of the engine cylinders on the basis of at least the second signal series, a control timing arithmetic means for arithmetically determining control timings for controlling the parameter or parameters on the basis of the results of the cylinder identification performed by the cylinder identifying means and the second signal series, and an abnormality decision means for generating and outputting an abnormality decision signal to the cylinder identifying means and the control timing arithmetic means upon detection of a failure in one of the first and second signal series.

By providing the first detector for detecting the first signal series (the angular position signal) containing the reference position signal for the given or specific cylinder group in association with the crank shaft as described above, it is possible to enhance the accuracy of timings for controlling the operation of the internal combustion engine. Furthermore, by providing the second detector for detecting the second signal series (cylinder identifying signal) in association with the cam shaft, the cylinder identification can easily and reliably be realized. Besides, by combination of the cylinder identifying signal, the reference position signal and the angular position signal, the cylinder identification which is to be reflected onto the timing control of the internal combustion engine can be carried out rapidly. Besides, by the backup control effected by using the cylinder identifying signals corresponding to the individual cylinders, respectively, the internal combustion engine performance can be ensured at least to a necessary minimum even in the case where the first signal series is unavailable.

In a preferred mode for carrying out the invention, the cylinder identifying signal of the second signal series for identifying the given one cylinder may be formed by a pulse having a phase overlapping that of the reference position signal so that the cylinder identifying means can identify the given one cylinder on the basis of a signal level of the second signal series at a time point at which the reference position signal is detected.

Owing to the arrangement in which the phase of the cylinder identifying signal (second signal series) for the given or specific engine cylinder is overlapped to that of the reference position signal, the cylinder group can rapidly be identified on the basis of the cylinder identification signal level upon detection of the reference position signal.

In another preferred mode for carrying out the invention, the control timing arithmetic means may be so designed as to arithmetically determine the control timing for the parameter by counting pulses of the angular position signal.

By virtue of the arrangement mentioned above, the control timing can arithmetically be determined with high accuracy by counting the angular position signal pulses.

In yet another preferred mode for carrying out the invention, the reference position signal may correspond to a low ("L") level interval during which the angular position signal is not generated continuously. In that case, a terminal end of the low level interval or the reference position signal may be so selected as to correspond to the reference position of the specific cylinder group.

By providing the low or "L" interval in the first signal series with the reference position for each of the individual cylinders being set at the time point at which generation of the succeeding angular signal is started, the reference position signal can be obtained with high accuracy notwithstanding of simplified hardware structure.

In still another preferred mode for carrying out the invention, the reference position signal may be formed by a pulse which is inserted in the angular position signal and which has a signal level differing from that of the pulses forming the angular position signal.

By inserting in the first signal series the pulses of level differing from the former for identifying the reference position of the specific or given engine group, it is possible to derive rapidly and accurately the reference position signal with simplified structure.

In a further preferred mode for carrying out the invention, the cylinder identifying signal may contain a pulse for identifying the specific or given one cylinder, the pulse having a pulse width differing from those of the other pulses for identifying the other engine cylinders.

By setting the pulse width of the cylinder identifying signal for the given or specific engine cylinder so as to be different from those for the other cylinders, the engine cylinder identification can easily be accomplished.

In a yet further preferred mode for carrying out the invention, the cylinder identifying signal may contain at least one additional pulse generated within a predetermined angle relative to the cylinder identifying signal pulse for identifying the specific or given one engine cylinder.

By generating the additional pulse in the vicinity of the cylinder identifying signal pulse for identifying the specific or given one cylinder, the cylinder identification can be carried out easily and rapidly.

In a still further preferred mode for carrying out the invention, the cylinder identifying means may be so implemented as to measure a time interval during which the cylinder identifying signal is generated on the basis of a count value of pulses contained in the angular position signal, to thereby identify discriminatively the individual engine cylinders from one another on the basis of the results of the measurement.

By measuring the duration of the interval during which the cylinder identifying signal is generated by counting the angular position signal pulses, as mentioned above, the cylinder identification can be realized with high reliability.

In a further preferred mode for carrying out the invention, the cylinder identifying means may be so arranged as to identify the individual engine cylinders on the basis of ratios of time intervals during which the cylinder identifying signals are generated, respectively.

By arithmetically determining the duty ratio of the cylinder identifying signal pulse, as mentioned above, the cylinder identification can be realized with high accuracy even when the first signal series can not be obtained, whereby the backup control can be realized with high accuracy and reliability.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
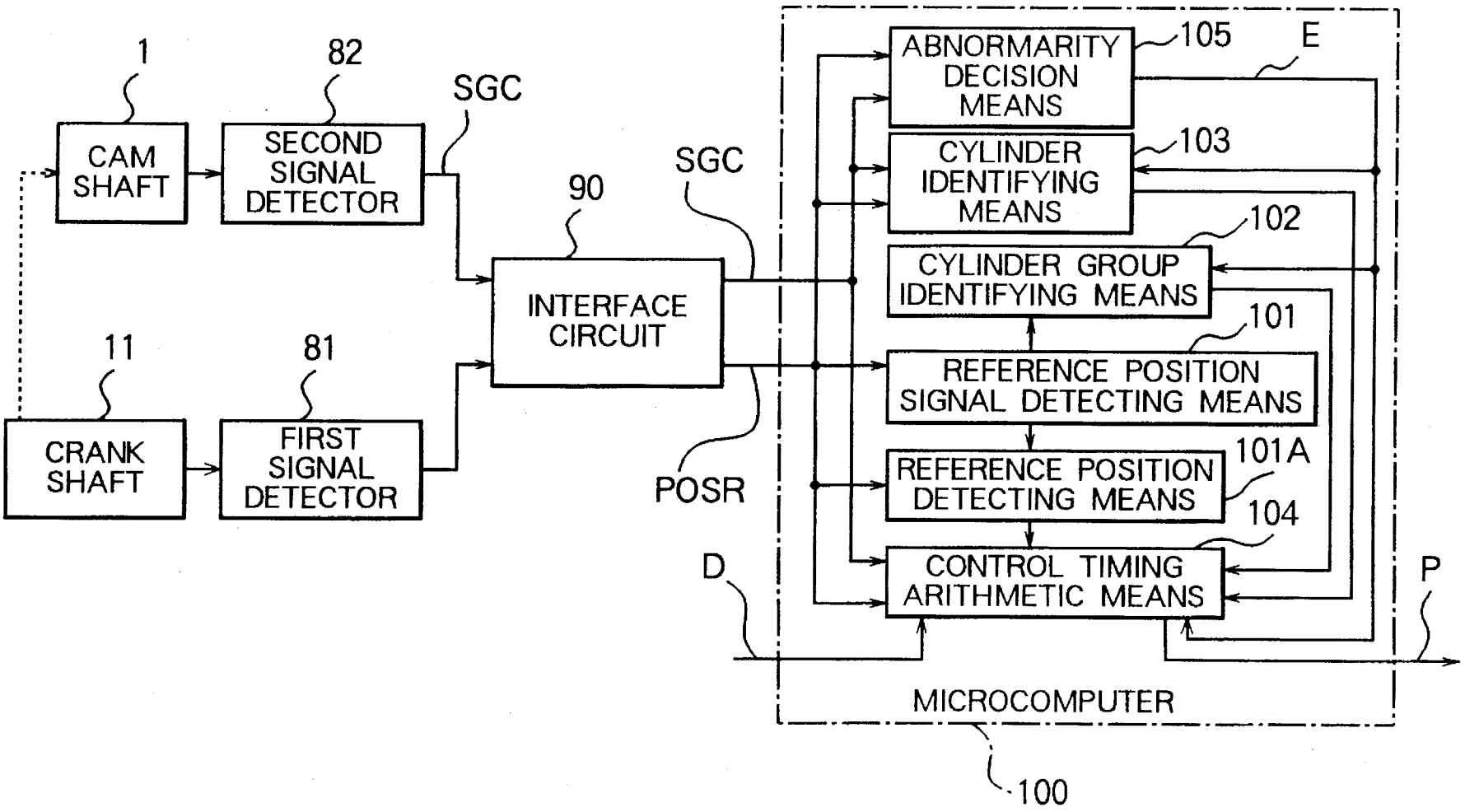
FIG. 1 is a functional block diagram showing schematically a general arrangement of an engine control apparatus according to a first embodiment of the invention.

In the following, the present invention will be described in detail in conjunction with what is presently considered as preferred or typical embodiments thereof by reference to the drawings. In the following description, like reference characters designate like or corresponding parts throughout the several views.

Embodiment 1

Figure 2:
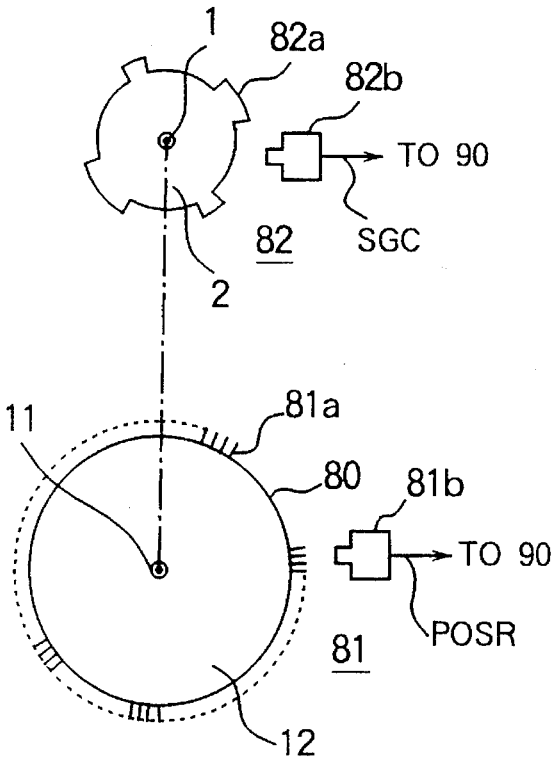
FIG. 2 is a view showing schematically structures of first and second signal detectors employed in the engine control apparatus according to the first embodiment of the invention.
Figure 3:
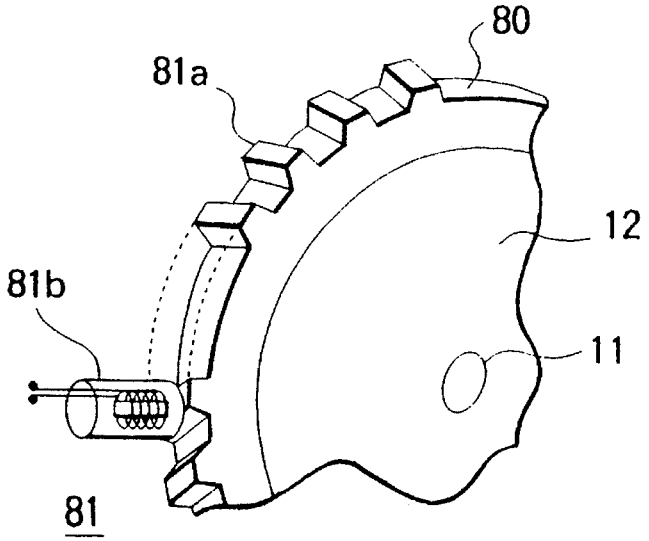
FIG. 3 is a fragmental perspective view showing exaggeratedly the first signal detector shown in FIG. 2.
Figure 4:
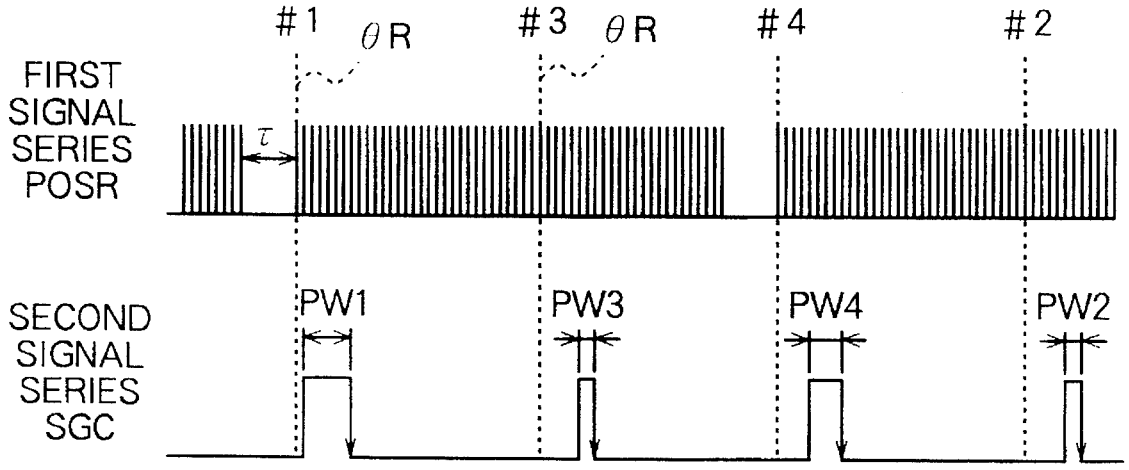
FIG. 4 is a waveform diagram for illustrating, by way of an example, the first and second signal series generated in the engine control apparatus according to the first embodiment of the present invention.

Now, the engine control apparatus according to a first embodiment of the present invention will be described by reference to FIGS. 1 to 4, wherein FIG. 1 is a functional block diagram showing schematically a general arrangement of the engine control apparatus according to the first embodiment of the invention, FIG. 2 is a view showing schematically structures of signal detectors employed in the engine control apparatus shown in FIG. 1, FIG. 3 is a fragmental perspective view showing exaggeratedly a first signal detector, and FIG. 4 is a waveform diagram for illustrating first and second signal series generated in the engine control apparatus according to the first embodiment of the invention.

Referring to FIG. 2, a cam shaft 1 is rotated in synchronism with a crank shaft 11 of an internal combustion engine by means of a transmission mechanism such as a belt drive mechanism with a speed reduction ratio of "½" relative to the crank shaft 11.

A first signal detector 81 designed to output a first signal series POSR which is associated with the rotation of the crank shaft 11 is comprised of a rotating disk 12 mounted integrally on the crank shaft 11 so as to corotate therewith, a plurality of projections 81*a* formed in the rotating disk 12 around an outer peripheral edge thereof with a first predetermined angular distance (e.g. for every crank angle in a range of 1° to 10°) and a sensor 81*b* which may be constituted by an electromagnetic pickup device, Hall element, magnetoresistance type sensor device or the like. In the case of the structure shown in FIG. 3, it is assumed, only by way of an example, that the sensor 81*b* is constituted by an electromagnetic pickup device.

The first signal series POSR includes angular position signal pulses generated at every first predetermined angular position of the crank shaft 11 in synchronism with the rotation thereof and reference position signals generated at every second predetermined angle (e.g. at every crank angle of 360°) which corresponds to a reference position of a specific or particular cylinder group (including e.g. cylinders #1 and #4 which can be controlled simultaneously) of the internal combustion engine.

The angular position signal contained in the first signal series POSR includes a series of pulses which are generated in correspondence to the individual projections 81*a* formed in succession around the outer peripheral edge of the rotating disk 12, wherein there is provided in the circumferential row of the projections 81*a* a non-toothed portion or segment 80 in which the projections or teeth 81*a* are absent over a predetermined angular range of ten to several ten degrees in terms of crank angle and in which the pulses of the angular position signal are not generated. It is to be noted that the terminal end of the non-toothed portion or segment 80 (corresponding to the start position of generation of the succeeding pulse train of the angular position signal) corresponds to the reference position θR of the specific engine cylinder group. Further, it should be noted that the non-toothed portion or segment 80 is provided at only one location of the outer peripheral edge of the rotating disk 12 mounted integrally on the crank shaft 11 (i.e., it is provided at every crank angle of 360°, to say in another way).

On the other hand, provided in association with the cam shaft 1 is a second signal detector 82 for generating a second signal series SGC, wherein the second signal detector 82 is constituted by a rotating disk 2 mounted integrally on the cam shaft 1 for corotarion therewith, a predetermined number of projections or teeth 82*a* formed in the rotating disk 2 around the outer peripheral edge in one-to-one correspondence to the engine cylinders, respectively, and a sensor 82*b* which may be constituted by an electromagnetic pickup device. Parenthetically, it is assumed, only by way of example, that the internal combustion engine now under consideration incorporates four cylinders. Accordingly, the number of the projections 82*a* is equal to four (refer to FIG. 2).

The second signal series SGC is composed of cylinder identifying signal pulses which are generated in correspondence to the individual engine cylinders, respectively, wherein the pulse corresponding to a specific one of the engine cylinders (the cylinder #1) has a pulse duration or width PW1 which is longer than the pulse widths PW2 to PW4 of the other cylinder identifying signal pulses.

The first signal series POSR and the second signal series SGC mentioned above are supplied to a microcomputer 100 by way of an interface circuit 90, as shown in FIG. 1.

The microcomputer 100 constitutes a control means for controlling parameters involved in the control of operation of the internal combustion engine. To this end, the microcomputer 100 is comprised of a reference position signal detecting means 101 for detecting a reference position signal relating to the specific cylinder group from the first signal series POSR, a reference position detecting means 101A for detecting the reference positions of the individual engine cylinders, respectively, on the basis of the angular position signal and the reference position signal contained in the first signal series POSR, a cylinder group identifying means 102 for discriminatively identifying cylinder groups on the basis of the reference position signal is detected, a cylinder identifying means 103 for identifying the individual cylinders on the basis of the temporal duration (pulse width) ratio of the cylinder identifying signal pulses of the second signal series SGC (cylinder identifying signal series), a control timing arithmetic means 104 for arithmetically determining or calculating control timings for the engine operation parameters (such as ignition timing and others) by counting the angular position signal pulses contained in the first signal series POSR, and an abnormality decision means 105 for outputting an abnormality decision signal E to the cylinder identifying means 103, the cylinder group identifying means 102 and the control timing arithmetic means 104 upon detection of occurrence of a failure in the first signal series POSR.

The cylinder identifying means 103 is adapted to identify the engine cylinders on the basis of at least the second signal series SGC, while the control timing arithmetic means 104 is so arranged as to arithmetically determine the control timing for the control parameter P on the basis of at least the result of the engine cylinder identification performed by the cylinder identifying means 103 and the second signal series SGC.

By way of example, when the engine system operates normally, the cylinder identifying means 103 measures the time intervals or periods during which the cylinder identifying signal pulses contained in the second signal series SGC are generated, respectively, by counting the angular position signal pulses contained in the first signal series POSR during the corresponding time intervals, respectively, to thereby identify discriminatively the individual engine cylinders on the basis of the results of the measurement, as will be described later on. On the other hand, upon occurrence of abnormality (such as occurrence of unavailability or absence of the first signal series POSR), the cylinder identifying means 103 responds to the abnormality decision signal E issued by the abnormality decision means 105 to thereby discriminatively identify the individual engine cylinders on the basis of the result of the calculation of the ratio of the temporal duration of the cylinder identifying signal pulse (e.g. the duty ratio between the duration of "H" level and that of "L" level adjacent to each other) by using only the second signal series SGC. In this manner, a backup control can be realized.

Similarly, the control timing arithmetic means 104 arithmetically determines or calculates the control timings for the engine operation parameter by counting the angular position signal pulses by making use of the reference position signal contained in the first signal series POSR as well as the cylinder identifying signal contained in the second signal series SGC, so long as the engine operation is normal. By contrast, upon occurrence of abnormality (i.e., in the state in which the first signal series POSR can not be obtained), the control timing arithmetic means 104 responds to the abnormality decision signal E issued by the abnormality decision means 105 to thereby realize the backup control by relying on only the second signal series SGC. Furthermore, in the case where the second signal series SGC can not be obtained, the control timing arithmetic means 104 performs the backup control by simultaneously firing the engine cylinders belonging to the same group by making use o only the result of the identification performed by the cylinder group identifying means 102 on the basis of the first signal series POSR.

Parenthetically, so long as the engine operation is normal, the control timing arithmetic means 104 arithmetically determines the control parameters P such as the ignition timing, the fuel injection quantity and others by reference to data stored in the form of a map in a memory (not shown) on the basis of operation state signals D supplied from a variety of sensors (not shown), to thereby control the individual engine cylinders in accordance with the control parameters P as determined.

Now, referring to FIG. 4, description will be made of operation of the engine control system implemented in the structure shown in FIGS. 1 to 3 according to the first embodiment of the present invention.

As mentioned previously, the rotating disk 12 having the projections or teeth 81*a* formed over every first predetermined angle around the outer peripheral edge is mounted on the crank shaft 11 with the sensor 81*b* being disposed in opposition to the projections 81*a* to thereby constitute the first signal detector 81 for generating the first signal series POSR which contains the angular position signal pulse corresponding to the projections 81*a*, respectively, and the reference position signal corresponding to the non-toothed segment 80.

In this conjunction, it should be recalled that the row of the projections 81*a* is partially provided with the non-toothed portion or segment 80 (at one location on the outer peripheral edge of the rotating disk 12 in the case of the four-cylinder engine) so that the first signal series POSR includes not only the angular position signal pulses but also the reference position signal.

The non-toothed segment 80 is detected by the sensor 81*b* which transforms the presence/absence of the projections or teeth 81*a* into the first signal series POSR (electric signal) to be inputted to the reference position signal detecting means 101 incorporated in the microcomputer 100, wherein the non-toothed segment 80 is detected or identified by the reference position signal detecting means 101 by comparing the intervals at which the angular position signal pulses and the reference position signal pulse are generated, respectively.

Thus, the first signal series POSR (refer to FIG. 4) generated in correspondence to the projections 81*a* formed in the rotating disk 12 mounted on the crank shaft 11 contains the angular position signals constituted by the pulses generated upon every predetermined angle (e.g. at every crank angle of 1°) and the reference position signal which is generated at every crank angle of 360° amid constituted by the pulse equivalent to the interval or period $\tau$ of "L" level during which the angular position signal can not be obtained over a predetermined angle corresponding to a crank angle of ten to several ten degrees.

At this juncture, it should be mentioned that the position at which the interval $\tau$ of "L" level is terminated (i.e., the position at which generation of the succeeding angular position signal is started) represents the reference position $\theta R$ which is employed in the arithmetic determination of the control timing for the specific cylinder group.

More specifically, the cylinder group identifying means 102 identifies the specific cylinder group and the other cylinder group discriminatively from each other on the basis of only the reference position signal generated by the reference position signal detecting means 101. Thus, the control timing arithmetic means 104 can speedily identify the group of cylinders which can be fired simultaneously on a group-by-group basis. In this manner, the engine control performance can be ensured at least to a necessary minimum.

On the other hand, the second signal series SGC generated in correspondence to the projections 82*a* formed in the rotating disk 2 mounted on the cam shaft 1 contains the cylinder identifying signal pulses, wherein the pulse corresponding to a specific cylinder (e.g. the cylinder #1) is so set as to have the pulse width PW1 which is longer than the other engine cylinders by forming the projection 82*a* corresponding to the specific cylinder longer than those for the other cylinders.

Thus, the cylinder identifying means 103 can identify the specific cylinder and the other cylinders discriminatively, whereby the control timing arithmetic means 104 can realize a desired engine control performance on the basis of the result of the cylinder identification executed by the cylinder identifying means 103.

Of course, so long as the first signal series POSR and the second signal series SGC are obtained without failure, the cylinder identifying means 103 can discriminatively identify the specific engine cylinder as well as the other cylinders by measuring the pulse width of the second signal series SGC while counting the number of the angular position signal pulses contained in the first signal series POSR.

On the other hand, unless the first signal series POSR can be obtained normally due to a failure or defect of the sensor 81*b* provided in association with the crank shaft 11 (i.e., when the first signal series POSR continues to remain at a constant level or exhibits an abnormal pulse width), the abnormality decision means 105 generates the abnormality decision signal E which is then inputted to the cylinder group identifying means 102, the cylinder identifying means 103 and the control timing arithmetic means 104, as can be seen in FIG. 1.

In response, the cylinder identifying means 103 performs the engine cylinder identification on the basis of only the second signal series SGC, to thereby permit the backup control of the control parameter P of the internal combustion engine.

In more concrete, the cylinder identifying means 103 performs calculation and comparison of the ratios betweal the "H"-level durations and the "L"-level durations of the pulses contained in the second signal series SGC sequentially to thereby identify the specific engine cylinder on the basis of the pulse having the greatest pulse width PW1 during which the second signal series SGC is at "H" level and then identifying the other cylinders successively.

In this case, by setting the timings at which the individual pulses of the second signal series SGC fall as the ignition timings for the individual cylinders, there can be ensured the internal combustion engine control performance required at least to a necessary minimum for the engine control.

Furthermore, when the second signal series SGC is not available due to a failure or defect of the sensor 82*b* provided in association with the cam shaft 1, the control timing arithmetic means 104 can perform the backup control by resorting to the groupwise simultaneous firing control on the basis of only the result of the cylinder group identification based on the reference position signal contained in the first signal series POSR. Thus, the engine control performance as required can be ensured at least to a necessary minimum.

As will now be appreciated, by providing the first signal detector 81 for detecting the first signal series POSR containing the angular position signal and the reference position signal in association with the crank shaft 11, there takes place no phase difference due to interposition of the transmission mechanism such as the belt drive mechanism. Thus, the crank angle and the reference position θR can be detected with high accuracy, which in turn means that the ignition timings as well as the fuel injection quantity can be controlled with high accuracy.

Furthermore, owing to the reference position signal set for the specific cylinder group, the specific cylinder group can be identified upon every detection of the reference position θR, whereby the group of the engine cylinders which can simultaneously be controlled can be detected rapidly and easily. Thus, the ignition timing control and the fuel injection control can be carried out rapidly and properly in particular upon starting of the engine operation.

Additionally, even in the case where the first signal series POSR can not be obtained due to a fault of the first signal detector 81 or for any other reason, the backup function for the engine cylinder identification as well as for the reference position identification can be realized on the basis of the duty cycle of the pulses contained in the second signal series SGC, whereby the ignition timing control and the fuel injection control can continuously be sustained by the backup control.

Embodiment 2

In the case of the engine operation timing control apparatus according to the first embodiment of the invention described above, the pulse width PW1 of the cylinder identifying signal for the specific cylinder is made to differ from those of the cylinder identifying signals for the other engine cylinders, for thereby allowing the specific engine cylinder to be identified discriminatively from the others. However, such identification of the specific engine cylinder can be realized by making only the cylinder identifying signal pulse for the specific cylinder overlap the reference position signal in the phase relation so that the specific cylinder can be identified on the basis of the level of the second signal series SGC at the reference position θR.

Figure 5:
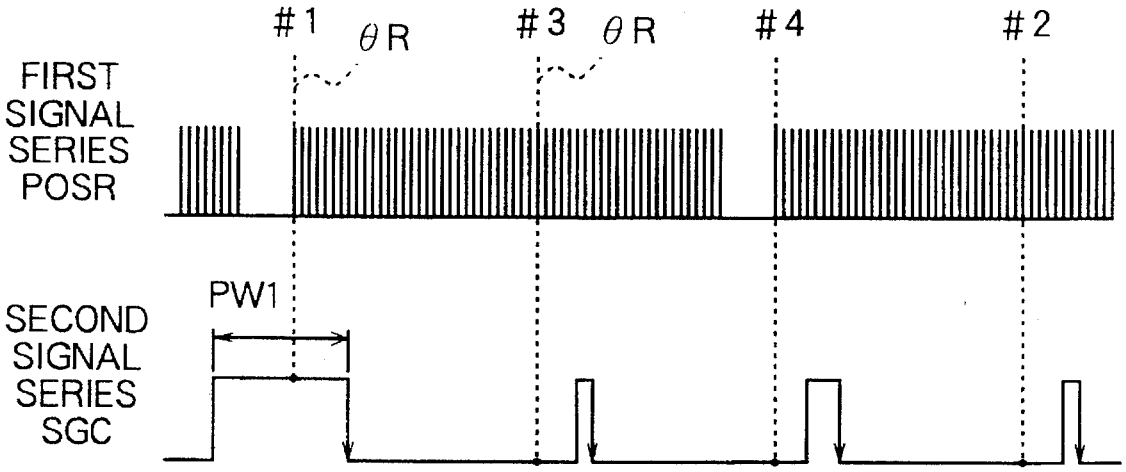
FIG. 5 is a waveform diagram for illustrating operation of an engine control apparatus according to a second embodiment of the invention.

FIG. 5 is a waveform diagram for illustrating operation of the control apparatus according to a second embodiment of the present invention in which the pulse of the cylinder identifying signal for the specific cylinder is caused to overlap the reference position signal.

Although the pulse width PW1 of the pulse for the specific cylinder is shown as set to be longer than those for the other engine cylinders, it should be appreciated that the pulse width PW1 may be equal to the latter, so long as the pulse for the specific cylinder coincides with the reference position signal in respect to the phase.

As can be seen from FIG. 5, the phase of the second signal series pulse for the specific cylinder (cylinder #1) coincides with that of the reference position signal contained in the first signal series POSR, and thus the second signal series pulse for the specific cylinder assumes a high or "H" level at the reference position θR. On the other hand, the second signal series pulses for the other engine cylinders assume low or "L" level at the reference position θR because no overlap takes place between these pulses and the reference position signal.

In other words, the cylinder identification signal pulse for the specific cylinder (i.e., cylinder #1) which has the pulse width PW1 is at "H" level throughout a time interval covering the "L" level interval τ of the first signal series POSR, while the cylinder identification signal pulses for the other engine cylinders (i.e., the cylinders #3, #4 and #2) can assume the "H" level only after the respective reference positions θR, which can be determined from the first signal series POSR.

Thus, it can be seen that the second signal series (SGC) pulse assuming the "H" level at the reference position θR identifies the specific cylinder while the second signal series (SGC) pulses which are at "L" level at the reference positions θR correspond to the other engine cylinders, respectively.

By virtue of the phase relation established between the second signal series SGC and the first signal series POSR as described above, the cylinder identifying means 103 can discriminatively identify the specific cylinder on the basis of the level of the second signal series SGC at the time point at which the reference position θR is detected by the reference position detecting means 101A with the other engine cylinders being identified in succession.

With the teachings of the present invention incarnated in the second embodiment thereof described above, the engine cylinder can be identified by referencing the level of the second signal series (SGC) pulses upon every detection of the reference position θR, thus rendering it unnecessary to measure the pulse width. Accordingly, the individual engine cylinders can be identified speedily and easily, whereby the ignition timing control as well as the fuel injection control of the internal combustion engine can be effectuated optimally with high-speed response.

Embodiment 3

In the case of the engine operation control apparatus according to the second embodiment of the invention described above, the pulse contained in the second signal series SGC and identifying the specific engine cylinder is so set as to overlap the reference position signal pulse. However, such arrangement may equally be adopted that an additional pulse is generated in addition to the specific cylinder identifying signal pulse in the vicinity thereof within a predetermined angular range.

Figure 6:
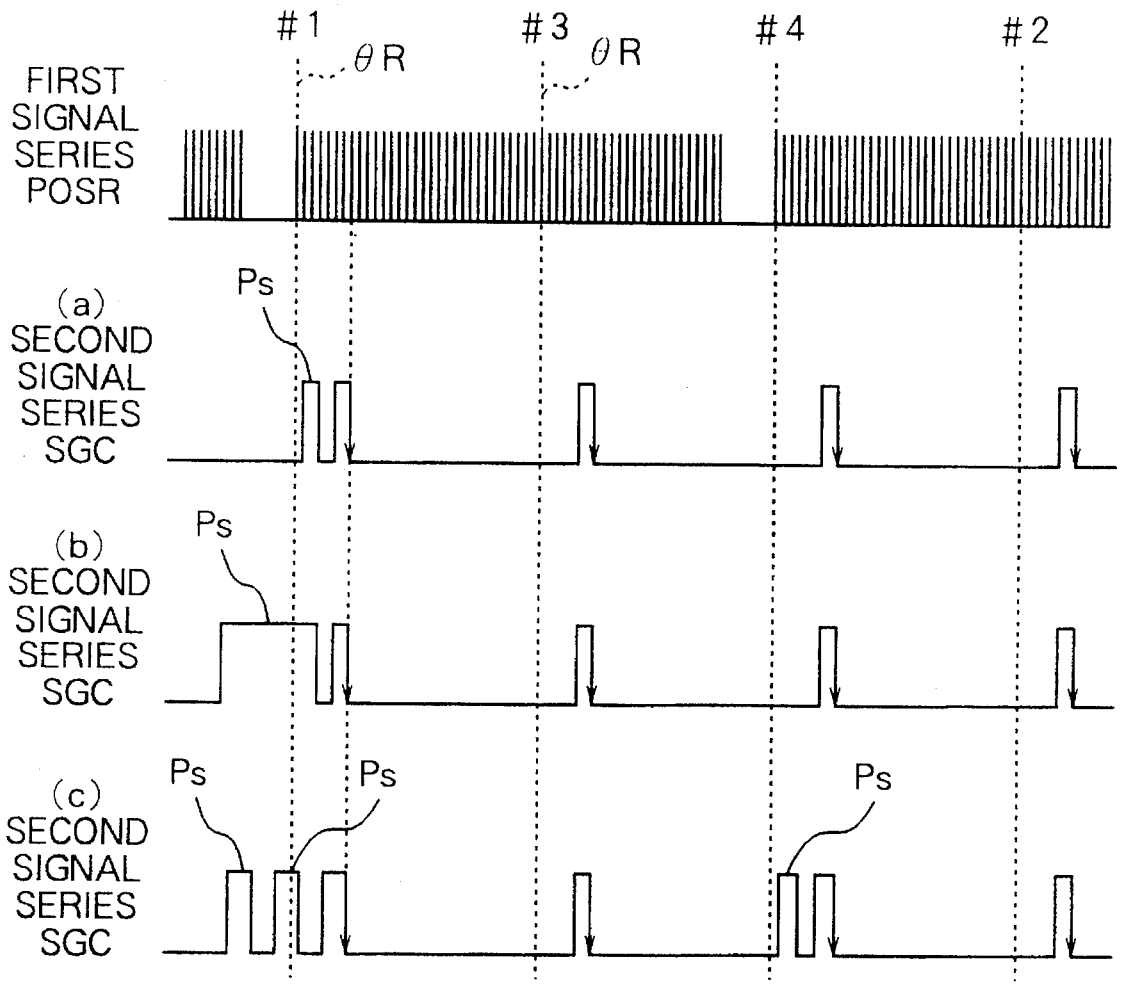
FIG. 6 is a waveform diagram for illustrating operation of an engine control apparatus according to a third embodiment of the invention.

FIG. 6 is a waveform diagram for illustrating operation of the engine control apparatus according to a third embodiment of the invention in which an additional pulse Ps is generated in the vicinity of the specific engine cylinder identifying signal pulse.

Referring to FIG. 6, there are illustrated at (a), (b) and (c), respectively, waveforms of the second signal series SGC which differ from one another. More specifically, there is illustrated at (a) in FIG. 6 a waveform of the second signal series SGC in which an additional pulse Ps is generated in the vicinity of the specific cylinder identifying signal pulse, while a waveform of the second signal series SGC in which the additional pulse Ps for identifying the specific cylinder has an extended pulse width is illustrated at (b). Further illustrated at (c) is a waveform of the second signal series SGC in which two additional pulses Ps are generated for the specific cylinder (cylinder #1) with one additional pulse being generated for the cylinder (cylinder #4) which belongs to the same group as the specific cylinder.

As is apparent from the waveforms (a) to (c) of FIG. 6, the specific cylinder can be identified discriminatively from the other cylinders in terms of presence/absence of the additional pulse Ps, pulse width thereof or the number thereof. Thus, the pulses for identifying the engine cylinders, respectively, may have a same pulse width except for the additional pulse Ps.

Referring to FIG. 6 at (a), the specific engine cylinder can discriminatively be identified by the cylinder identifying means 103 by detecting the additional pulse Ps generated within a predetermined angular range in the vicinity of the intrinsic engine cylinder identifying signal pulse for the specific cylinder.

More specifically, so long as the first signal series POSR and the second signal series SGC are generated normally, it is possible to detect the additional pulse Ps generated within a predetermined angular range relative to the intrinsic engine cylinder identifying signal pulse by counting the angular position signal pulses contained in the first signal series POSR. On the other hand, when the first signal series POSR can not be obtained, existence of the additional pulse Ps within the predetermined angular range can discriminatively be detected through comparison of the duty ratios of the pulses contained in the second signal series SGC.

In the case where the pulse waveform of the second signal series SGC shown in FIG. 6 at (b) is employed, the cylinder identification can be realized by taking into account the duration of the second signal series pulses at the reference position θR. Thus, the reliability of the cylinder identification can further be enhanced.

Furthermore, when the pulse waveform shown in FIG. 6 at (c) is employed, two additional pulses Ps are generated from identifying the specific cylinder (#1) while one additional pulse Ps is added for identifying the cylinder (#4) which belongs to the same cylinder group as the specific cylinder (#1). Thus, the specific cylinder (#1) as well as the counter part cylinder (#4) belonging to the same cylinder group can straightforwardly be identified, respectively.

Parenthetically, the number of the additional pulses Ps can be selected rather arbitrarily.

At this juncture, it should be mentioned that when the first signal series POSR can not be obtained in the case where the pulse waveform shown at (a), (b) or (c) in FIG. 6 is used, it is possible to identify the individual engine cylinders by determining the number of the additional pulses Ps or the pulse width thereof through the arithmetic determination of the duty ratios of the pulses contained in the second signal series SGC, as described hereinbefore.

In this way, the control timing arithmetic means 104 can perform in continuation the desired backup control by utilizing as the control timings the falling time points of the pulses (or pulse groups including the additional pulse Ps) contained in the second signal series SGC (the falling time points mentioned above coincide with one another for the individual engine cylinders, respectively, as indicated by arrows in FIG. 6).

Embodiment 4

In the engine control apparatuses according to the preceding embodiments of the invention, the "L" level interval or period τ during which the angular position signal is not continuously generated is used as the reference position signal contained in the first signal series POSR. To this end, however, the pulses of different levels contained in the angular position signal generated continuously may be used.

Figure 7:
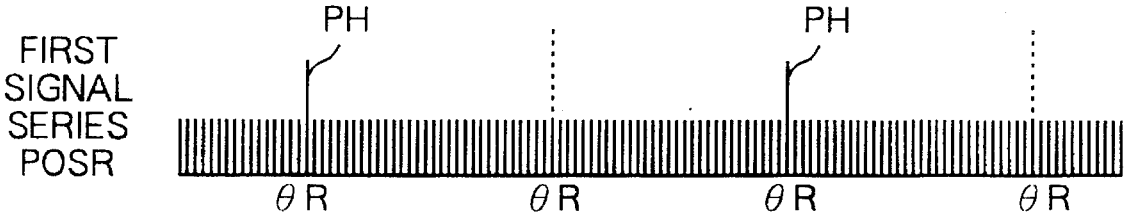
FIG. 7 is a waveform diagram for illustrating operation of an engine control apparatus according to a fourth embodiment of the invention.
Figure 8:
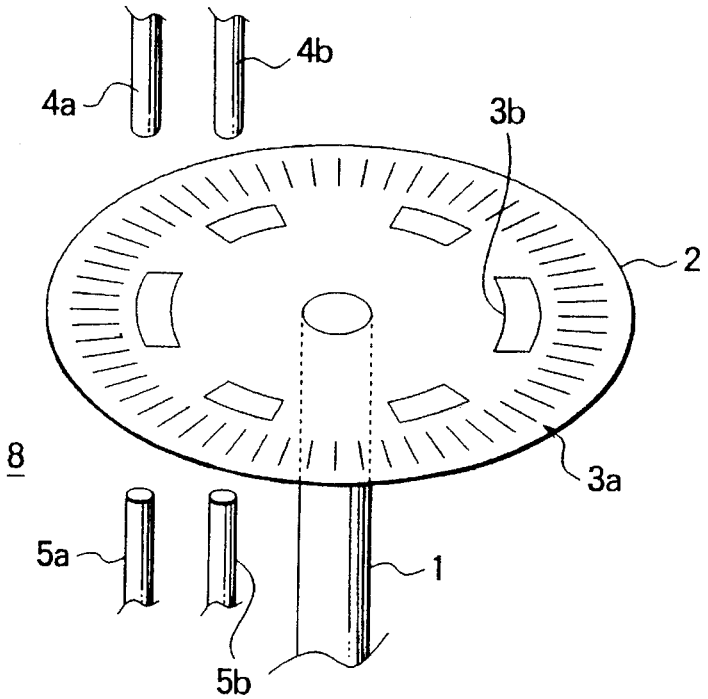
FIG. 8 is a perspective view showing a mechanical structure of a rotation signal generator employed in a hitherto known engine control apparatus.
Figure 9:
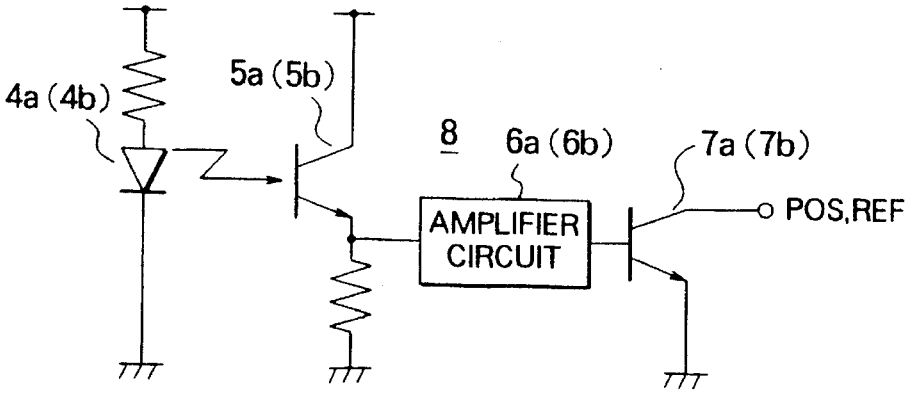
FIG. 9 is a circuit diagram showing an electric signal processing circuit of the rotation signal generator employed in the hitherto known engine control apparatus.
Figure 10:
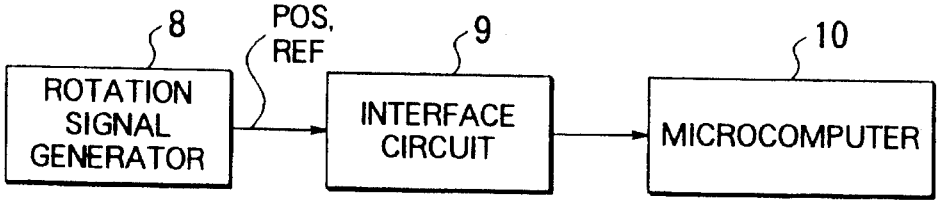
FIG. 10 is a block diagram showing a structure of the engine control apparatus known heretofore.
Figure 11:
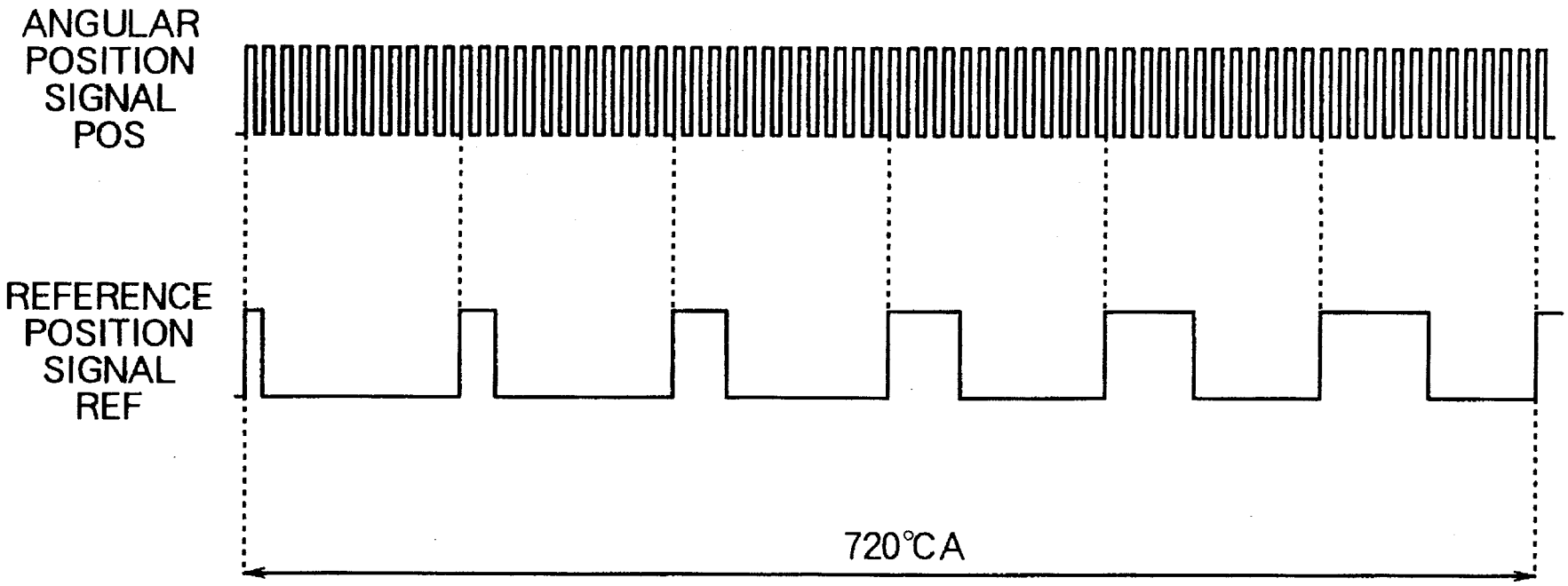
FIG. 11 is a waveform diagram for illustrating operation of the hitherto known engine control apparatus.

FIG. 7 is a waveform diagram for illustrating operation of the engine control apparatus according to a fourth embodiment of the present invention. Referring to FIG. 7, a pulse PH having the level differing from that of the other angular position signal pulses is generated, wherein the position at which the pulse PH having the different level (high level) corresponds to the reference position θR for the specific cylinder group.

In the case of the instant embodiment of the invention, the projections 81*a* (refer to FIG. 3) formed around the outer peripheral edge of the rotating disk 12 mounted on the crank shaft 11 can be provided continuously along the whole circumference without any interruption or non-toothed portion 80. Furthermore, permanent magnet (not shown) is provided at a position corresponding to the reference position θR of the specific cylinder group (at a single location in the case of the four-cylinder engine) in place of the projection 81*a*.

By placing or mounting the permanent magnet on the outer peripheral edge of the rotating disk 12 at one location, as described above, a large pulse PH makes appearance in the first signal series POSR at every reference position θR for the specific cylinder group (at every crank angle of 360°). Thus, the specific cylinder group as well as the reference position θR thereof can speedily and easily be detected. Further, by counting the angular position signal pulses, the reference position θR for the other cylinder group can be detected.

Furthermore, by using the pulse PH having the level or amplitude which differs from that of the angular position signal, as shown in FIG. 7, detection of the reference position θR of the specific cylinder group can be performed rapidly, because it is no more required to wait for the termination of the interval τ of "L" level at which generation of the angular position signal is restarted (see FIGS. 4 to 6).

What is claimed is:

1. An apparatus for controlling operation of an internal combustion engine, comprising:

a first signal detector for generating a first signal series relating to rotation of a crank shaft of said internal combustion engine;

a second signal detector for generating a second signal series relating to rotation of a cam shaft driven with a speed reduction ratio of "½" relative to said crank shaft; and control means for controlling at least one parameter involved in operation of said internal combustion engine on the basis of at least one of said first and second signal series;

said first signal series including an angular position signal generated at every first predetermined angular position in synchronism with the rotation of said crank shaft and a reference position signal generated at every second predetermined angular position corresponding to a reference position of a specific cylinder group of said engine;

said second signal series containing pulses corresponding to said cylinders, respectively, and a cylinder identifying signal for a given one of said cylinders, wherein a pulse form of said cylinder identifying signal at least for said given one cylinder differs from those for the other engine cylinders;

said control means including:

reference position signal detecting means for detecting said reference position signal on the basis of said first signal series;

reference position detecting means for detecting reference positions for said cylinders, respectively, on the basis of said angular position signal and said reference position signal;

cylinder group identifying means for identifying said cylinder group on the basis of said reference position signal;

cylinder identifying means for discriminatively identifying each of said engine cylinders on the basis of at least said second signal series;

control timing arithmetic means for arithmetically determining control timings for controlling said parameter on the basis of the results of the cylinder identification performed by said cylinder identifying means and said second signal series; and abnormality decision means for generating and outputting an abnormality decision signal to said cylinder identifying means and said control timing arithmetic means upon detection of a failure in one of said first and second signal series.

2. A control apparatus for an internal combustion engine according to claim 1, said cylinder identifying signal of said second signal series for identifying said given one cylinder being formed by a pulse having a phase overlapping that of said reference position signal, wherein said cylinder identifying means identifies said given one cylinder on the basis of a signal level of said second signal series at a time point at which said reference position signal is detected.

3. A control apparatus for an internal combustion engine according to claim 1, wherein said control timing arithmetic means is so arranged as to arithmetically determine the control timing for said parameter by counting pulses of said angular position signal.

4. A control apparatus for an internal combustion engine according to claim 1, wherein said reference position signal corresponds to a low level interval during which said angular position signal is not generated continuously, and wherein a terminal end of said low level interval is so selected as to correspond to the reference position of said specific cylinder group.

5. A control apparatus for an internal combustion engine according to claim 1, wherein said reference position signal is formed by a pulse which is inserted in said angular position signal and which has a signal level differing from that of the pulses forming said angular position signal.

6. A control apparatus for an internal combustion engine according to claim 1, wherein said cylinder identifying signal contains a pulse for identifying said given one cylinder, said pulse having a pulse width differing from those of the other pulses for identifying the other engine cylinders.

7. A control apparatus for an internal combustion engine according to claim 1, wherein said cylinder identifying signal contains at least one additional pulse generated within a predetermined angle relative to said cylinder identifying signal pulse for identifying said given one engine cylinder.

8. A control apparatus for an internal combustion engine according to claim 1, wherein said cylinder identifying means is so implemented as to measure a time interval during which said cylinder identifying signal is generated on the basis of a count value of pulses contained in said angular position signal, to thereby identify discriminatively the individual engine cylinders from one another on the basis of the results of said measurement.

9. A control apparatus for an internal combustion engine according to claim 1, wherein said cylinder identifying means is so implemented as to identify the individual engine cylinders on the basis of ratios of time intervals during which said cylinder identifying signals are generated, respectively.

* * * * *